United States Patent [19]

Mondek

[11] Patent Number: 4,734,070

[45] Date of Patent: Mar. 29, 1988

[54] MARINE PROPULSION DEVICE AIR INTAKE SYSTEM

[75] Inventor: Martin J. Mondek, Wonder Lake, Ill.

[73] Assignee: Outboard Marine Corporation, Waukegan, Ill.

[21] Appl. No.: 879,032

[22] Filed: Jun. 26, 1986

[51] Int. Cl.[4] ..... B63H 21/26

[52] U.S. Cl. ..... 440/88; 440/900; 440/77; 181/229; 123/195 P

[58] Field of Search ..... 440/76, 77, 88, 900; 123/195 P, 198 E; 180/69.22, 69.25; 181/229

[56] References Cited

U.S. PATENT DOCUMENTS

| | | | |
|---|---|---|---|
| 2,798,470 | 7/1957 | Kiekhaefer | 181/229 |
| 2,815,742 | 12/1957 | Kiekhaefer | 123/198 |
| 3,195,530 | 7/1965 | Heidner | 440/76 |
| 3,358,668 | 12/1967 | Post et al. | 123/198 |
| 3,557,902 | 1/1971 | Brown | 181/35 |
| 3,610,198 | 10/1971 | Alexandrowicz | 115/17 |
| 3,773,010 | 11/1973 | Elingsen | 115/17 |
| 3,810,526 | 5/1974 | Kawasaki | 181/35 |
| 3,949,726 | 4/1976 | List | 123/198 E |
| 4,142,607 | 3/1979 | Landwehr et al. | 181/229 |
| 4,254,746 | 3/1981 | Chiba et al. | 181/229 |
| 4,348,194 | 9/1982 | Walsh | 440/77 |
| 4,354,458 | 10/1982 | Bury | 123/52 M |
| 4,379,702 | 4/1983 | Takada et al. | 440/77 |
| 4,403,971 | 9/1983 | Kobayashi et al. | 440/88 |
| 4,522,602 | 6/1985 | Okazaki | 440/77 |
| 4,620,607 | 11/1986 | Breckenfeld et al. | 123/198 E |

FOREIGN PATENT DOCUMENTS

| | | | |
|---|---|---|---|
| 56-157694 | 12/1981 | Japan . | |
| 58-194695 | 11/1983 | Japan | 440/88 |
| 58-194693 | 11/1983 | Japan . | |
| 59-120598 | 7/1984 | Japan | 440/88 |

*Primary Examiner*—Sherman D. Basinger
*Assistant Examiner*—Edwin L. Swinehart
*Attorney, Agent, or Firm*—Michael, Best & Friedrich

[57] ABSTRACT

A marine propulsion device comprising a propulsion unit including a rotatably mounted propeller, and an engine drivingly connected to the propeller and including an air intake, a cowl assembly surrounding the engine and including a front located adjacent the air intake and a rear including an air inlet, and a baffle for isolating air from the engine and for conducting the air around the engine from the air inlet to the air intake.

24 Claims, 8 Drawing Figures

MARINE PROPULSION DEVICE AIR INTAKE SYSTEM

BACKGROUND OF THE INVENTION

The invention relates to air intake systems for marine propulsion devices, and, more particularly, to air intake systems for outboard motors.

Outboard motors typically include a cowl assembly surrounding the engine. Various types of air intake systems are known for admitting combustion air into the cowl assembly and for conducting the combustion air to the engine. These known systems include various arrangements for preventing water from entering the cowl assembly and various air silencer arrangements.

In conventional intake systems, combustion air passes through the same space in which the engine is located and therefore is heated by the engine. This preheated combustion air reduces engine efficiency and can cause premature engine failure.

Attention is directed to the following U.S. Pat. Nos. which disclose outboard motor intake systems:

| | | |
|---|---|---|
| Okazaki | 4,522,602 | June 11, 1985 |
| Kobayashi et al. | 4,403,971 | Sep. 13, 1983 |
| Takada et al. | 4,379,702 | Apr. 12, 1983 |
| Walsh | 4,348,194 | Sep. 7, 1982 |
| Elingsen | 3,773,010 | Nov. 20, 1973 |
| Alexandrowicz | 3,610,198 | Oct. 5, 1971 |
| Brown, et al. | 3,557,902 | Jan. 26, 1971 |
| Post et al. | 3,358,668 | Dec. 19, 1967 |
| Heidner | 3,195,530 | July 20, 1965 |
| Kiekhaefer | 2,815,742 | Dec. 10, 1957 |

Attention is also directed to the following Japanese patents which disclose outboard motor intake systems:

| | | |
|---|---|---|
| Okazaki | 58-194693 | Dec. 11, 1983 |
| Kobayashi | 56-257694 | Apr. 12, 1981 |

Attention is further directed to the following U.S. Pat. Nos. which disclose internal combustion engine intake systems:

| | | |
|---|---|---|
| Bury | 4,354,458 | Oct. 19, 1982 |
| List | 3,949,726 | Apr. 13, 1976 |
| Kawasaki | 3,810,526 | May 14, 1974 |

SUMMARY OF THE INVENTION

The invention provides a marine propulsion device comprising a propulsion unit including a rotatably mounted propeller, and an engine drivingly connected to the propeller and including an air intake, a cowl assembly surrounding the engine and including an air inlet, and means for conducting air from the air inlet to the air intake while reducing heat exchange between the air and the engine.

In one embodiment, the cowl assembly includes an upper portion, and the air inlet is located in the upper portion.

In one embodiment, the cowl assembly has a front and a rear, the air intake is located adjacent the front of the cowl assembly, and the air inlet is located in the rear of the cowl assembly.

In one embodiment, the cowl assembly has a front and an upper rear, the air intake is located adjacent the front of the cowl assembly, and the air inlet is located in the upper rear of the cowl assembly.

In one embodiment, the cowl assembly has an interior surface, and the conducting means includes wall means sealingly connected to the interior surface of the cowl assembly, the wall means being spaced from the interior surface to define a passage communicating between the air inlet and the air intake.

In one embodiment, the cowl assembly has a front and a rear, the air intake is located adjacent the front of the cowl assembly, the air inlet is located in the rear of the cowl assembly, and the conducting means includes means for isolating air from the engine and for conducting the air around the engine from the air inlet to the air intake.

In one embodiment, the isolating and conducting means includes means defining a chamber located adjacent the front of the cowl assembly, the chamber communicating with the air intake and being substantially sealed from the engine, and means for conducting air around the engine from the air inlet to the chamber.

In one embodiment, the means for conducting air around the engine includes means for conducting air above the engine from the air inlet to the chamber.

In one embodiment, the cowl assembly includes a top wall and an interior surface, and the means for conducting air above the engine includes wall means sealingly connected to the interior surface and spaced from the top wall to define a passage communicating between the air inlet and the chamber.

In one embodiment, the isolating and conducting means includes means for substantially preventing water entering the air inlet from reaching the air intake.

In one embodiment, the cowl assembly includes a pan-like lower portion, the wall means includes a wall portion extending upwardly adjacent the air inlet and toward the front of the cowl assembly, the wall portion including a lower end located above the lower portion of the cowl assembly so that water entering the air inlet runs down the wall portion into the lower portion of the cowl assembly, and the water preventing means includes the wall portion.

In one embodiment, the cowl assembly has an interior surface, and the means defining the chamber includes an air silencer plate generally sealingly connected to the interior surface of the cowl assembly and spaced from the cowl assembly to define the chamber, the plate having therein an opening communicating with the air intake.

In one embodiment, the cowl assembly has opposite top and bottom walls, opposite front and rear walls, and opposite side walls, the air intake is located adjacent the front wall, the air inlet is located adjacent the rear wall, and the conducting means includes an air silencer plate extending between the side walls and being spaced from the front wall to define a first chamber between the front wall and the plate, the plate at least partially defining an air silencing chamber communicating with the air intake, the plate including an opening communicating between the first chamber and the air silencing chamber, and the plate having an upper end spaced from the top wall to define an opening communicating with the first chamber, and the conducting means also including a baffle extending between the side walls and rearwardly from the upper end of the cover plate, the baffle having a rearward end located adjacent the air inlet, and the baffle being spaced from the top wall to define a passage between the baffle and the top wall, the passage communicating between the air inlet and the opening into the first chamber.

In one embodiment, the plate has a lower end spaced from the bottom wall to define an opening which communicates with the first chamber and through which water can drain from the first chamber.

The invention also provides a marine propulsion device comprising a propulsion unit including a rotatably mounted propeller, and an engine drivingly connected to the propeller and including an air intake, a cowl assembly surrounding the engine and including an air inlet, and an air silencer. The air silencer includes spaced apart front and rear walls and a top wall, a silencer inlet located in the top wall adjacent the front wall, a silencer outlet located in the rear wall and communicating with the air intake, and means defining a tortuous passage communicating between the silencer inlet and the silencer outlet for conducting air from the silencer inlet to the silencer outlet and for substantially preventing water entering the silencer inlet from reaching the air intake. The means includes a baffle wall extending downwardly from the top wall intermediate the silencer inlet and the rear wall, the baffle wall extending to a point beneath the silencer outlet, whereby air entering the silencer inlet must pass downwardly between the baffle wall and the front wall, beneath the baffle wall, and upwardly between the baffle wall and the rear wall to the silencer outlet. The device also comprises means for conducting air from the air inlet to the silencer inlet.

In one embodiment, the tortuous passage includes a low point, and the air silencer further includes a drain opening communicating with the tortuous passage at the low point.

In one embodiment, the air silencer further includes a bottom wall having therein the drain opening.

A principal feature of the invention is the provision of a marine propulsion device comprising means for conducting air from the air inlet of the cowl assembly to the air intake of the engine while reducing heat exchange between the air and the engine. This provides cooler combustion air for the engine and thereby increases engine efficiency and prevents premature engine failure.

Another principal feature of the invention is the provision of a marine propulsion device comprising a cowl assembly surrounding the engine and including a front located adjacent the engine air intake and a rear including an air inlet, and means for isolating air from the engine and for conducting the air around the engine from the air inlet to the air intake.

Another principal feature of the invention is the provision of a marine propulsion device comprising an air silencer including means defining a tortuous passage communicating between the air silencer inlet and the air silencer outlet for conducting air from the inlet to the outlet and for substantially preventing water entering the inlet from reaching the outlet.

Other features and advantages of the invention will become apparent to those skilled in the art upon review of the following detailed description, claims and drawings.

Figure 1:
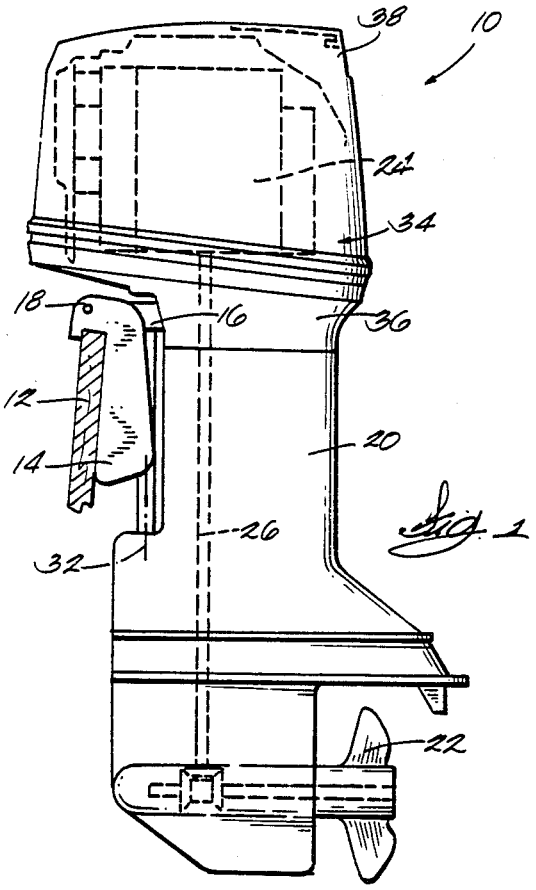
FIG. 1 is a side elevational view of a marine propulsion device which embodies various of the features of the invention and which includes a baffle and an air silencer.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 which embodies variations of the features of the invention is illustrated in the drawings. As shown in FIG. 1, the marine propulsion device 10 is preferably an outboard motor.

The marine propulsion device 10 comprises a mounting assembly adapted to be mounted on the transom 12 of a boat. While various suitable mounting assemblies can be employed, in the preferred embodiment, the mounting assembly includes a transom bracket 14 fixedly mounted on the transom 12, and a swivel bracket 16 mounted on the transom bracket 14 for pivotal movement relative thereto about a generally horizontal tilt axis 18.

The marine propulsion device 10 also comprises a propulsion unit 20 including a rotatably mounted propeller 22, and an engine 24 drivingly connected to the propeller 22 by a conventional drive train 26. The propulsion unit 20 is mounted on the swivel bracket 16 for pivotal movement relative thereto about a generally vertical steering axis 32, and for common pivotal movement therewith about the tilt axis 18. In the illustrated construction, as shown in FIG. 3, the engine 24 is a two-cylinder internal combustion engine including a flywheel 27 and a pair of carburetors 28 each including an air induction passage on air intake 30.

The marine propulsion device 10 also comprises a cowl assembly 34 surrounding or enclosing the engine 24. In the preferred embodiment, as best shown in FIGS. 3 and 4, the cowl assembly 34 includes a pan-like lower portion 36 and a dome-like upper portion 38 mounted on the lower portion 36. The lower portion 36 includes a bottom wall 40 of the cowl assembly 34, the upper portion 38 includes a top wall 42 of the cowl assembly 34, and both the upper and lower portions include opposite front and rear walls 44 and 46, respectively, and opposite side walls 48. All of these exterior walls of the cowl assembly 34 define an interior surface 50. In the preferred embodiment, the front wall 44 of the cowl assembly 34 is positioned such that the air intakes 30 are located adjacent the front wall 44.

Figure 3:
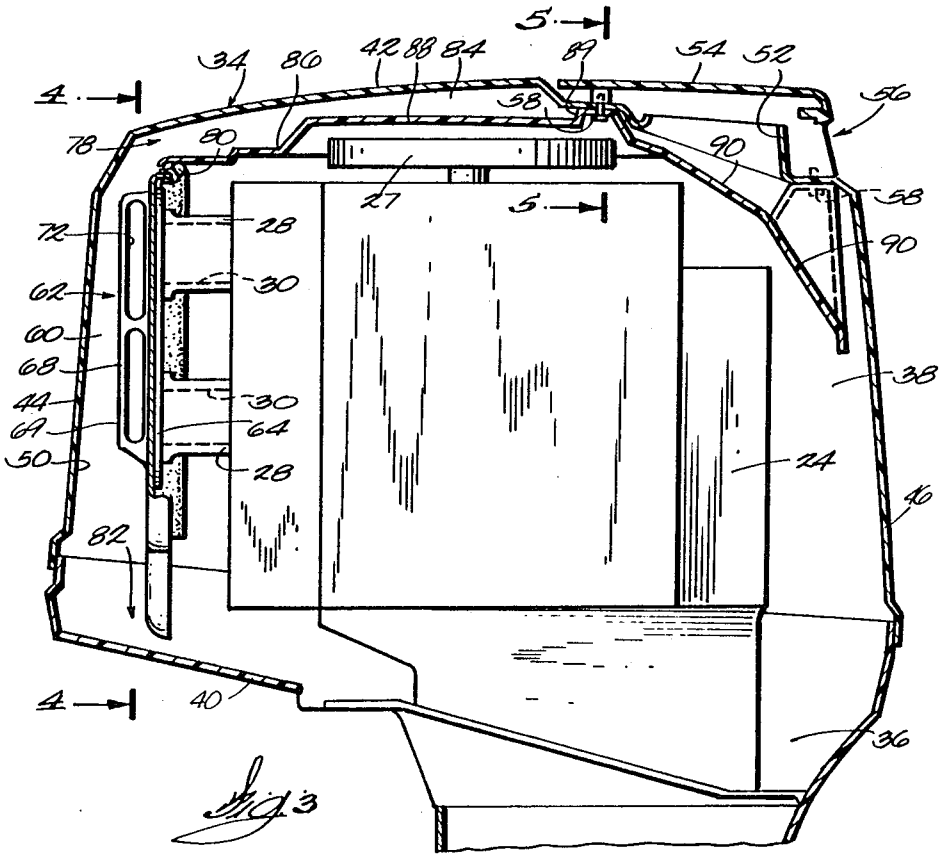
FIG. 3 is an enlarged side elevational view, partially in cross section, of the upper portion of the marine propulsion device.
Figure 4:
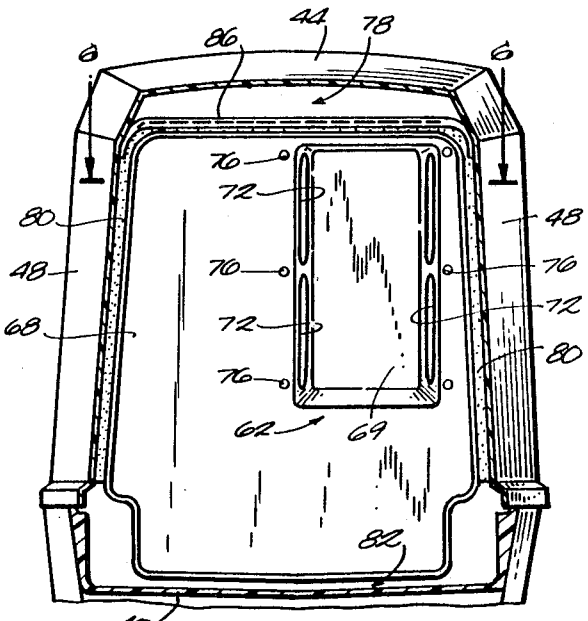
FIG. 4 is a cross sectional view taken along line 4—4 in FIG. 3.

As shown in FIG. 3, the cowl assembly 34 includes a combustion air inlet 52. In the preferred embodiment, the air inlet 52 is located in the upper rear of the cowl assembly 34, and, more particuarly, in the top wall 42 of the cowl assembly 34 adjacent the rear wall 46. Preferably, the cowl assembly 34 further includes a tilt handle 54 mounted on the top wall 42 and cooperating with the top wall 42 to define an opening 56 which facilitates handling of the propulsion unit 20 and which communicates with the air inlet 52. The tilt handle 54 can be secured to the cowl assembly 34 by any suitable means, such as screws 58.

The marine propulsion device 10 further comprises means for conducting air from the air inlet 52 to the air intakes 30 while reducing heat exchange between the air and the engine 24. Preferably, heat exchange is reduced by isolating the air from the engine 24. In the preferred embodiment, wherein the air intakes 30 are located adjacent the front of the cowl assembly 34 and the air inlet 52 is located adjacent the rear of the cowl assembly 34, the conducting means includes means for isolating air from the engine 24 and for conducting the air around the engine 24 from the air inlet 52 to the air intakes 30.

While various suitable isolating and conducting means can be employed, in the illustrated construction, the isolating and conducting means includes means defining a first chamber 60 (FIG. 3) located adjacent the front of the cowl assembly 34, the chamber 60 communicating with the air intakes 30 and being substantially sealed or isolated from the engine 24. The isolating and conducting means also includes means for conducting air around the engine 24 from the air inlet 52 to the chamber 60. Preferably, the means for conducting air around the engine 24 includes means for conducting air above the engine 24 from the air inlet 52 to the chamber 60. The isolating and conducting means preferably further includes means for substantially preventing water entering the air inlet 52 from reaching the air intakes 30.

Figure 6:
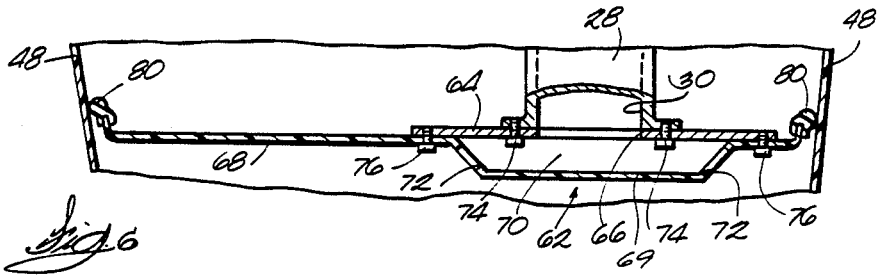
FIG. 6 is a cross-sectional view taken along line 6—6 in FIG. 4.

In the preferred embodiment, the means defining the chamber 60 includes an air silencer 62. As shown in FIGS. 3, 4 and 6, the air silencer 62 includes a base plate 64 mounted on the carburetors 28 and including openings 66 (FIG. 6) registering with the air intakes 30, and a cover plate 68 mounted on the base plate 64 and cooperating with the base plate 64 to define an air silencer chamber 70. As shown in FIG. 6, the cover plate 68 preferably incudes a projecting portion 69 defining the silencer chamber 70, and the cover plate 68 includes four openings 72 (two on either side of the projecting portion 69) communicating with the air silencing chamber 70. Preferably, as shown in FIG. 6, the base plate 64 is mounted on the carburetors 28 by screws 74, and the cover plate 68 is mounted on the base plate 64 by screws 76.

More particularly, in the preferred embodiment, the means defining the chamber 60 includes the air silencer cover plate 68. As shown in FIGS. 3 and 6, the cover plate 68 is generally sealingly connected to the interior surface 50 of the cowl assembly 34 and is spaced from the front wall 44 of the cowl assembly 34 to locate the chamber 60 between the front wall 44 and the cover plate 68. The cover plate 68 extends between the side walls 48 and has an upper end spaced from the top wall 44 to define an opening 78 (FIGS. 3 and 4) communicating with the chamber 60. A seal member 80 extending partially around the periphery of the cover plate 68 (specifically around the upper end and portions of the sides of the cover plate 68) sealingly connects the cover plate 68 to the side walls 48. The seal 80 assists in isolating the chamber 60 from the engine 24. In the preferred embodiment, the cover plate 68 has a lower end spaced from the bottom wall 40 of the cowl assembly 34 to define an opening 82 which communicates with the chamber 60 and through which water can drain from the chamber 60 into the lower portion 36 of the cowl assembly 34.

The means for conducting air above the engine 24 preferably includes wall means sealingly connected to the interior surface 50 of the cowl assembly 34 and spaced from the top wall 44 to define a passage 84 (FIG. 3) communicating between the air inlet 52 and the opening 78 into the chamber 60. While various suitable wall means can be used, in the preferred embodiment, the wall means includes (see FIGS. 2, 3 and 5) a baffle 86 extending between the side walls 48 and rearwardly from the upper end of the cover plate 68. The baffle 86 is spaced from the top wall 44 (but is located above the engine 24) to define the passage 84 between the baffle 86 and the top wall 44. Because the baffle 86 is located above the engine 24, the passage 84 is isolated from the engine 24.

Figure 7:
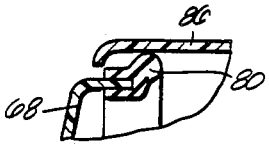
FIG. 7 is an enlarged cross-sectional view of the joint between the baffle and the air silencer.

The baffle 86 has a forward end which is sealingly connected to the upper end of the cover plate by the seal 80 (see FIG. 7). Thus, the seal 80 also assists in isolating the passage 84 from the engine 24. The baffle 86 also has a rearward end which is located adjacent the air inlet 52. In the illustrated construction, as shown in FIG. 3, the rearward or right end of the baffle 86 is located beneath the air inlet 52.

Figure 5:
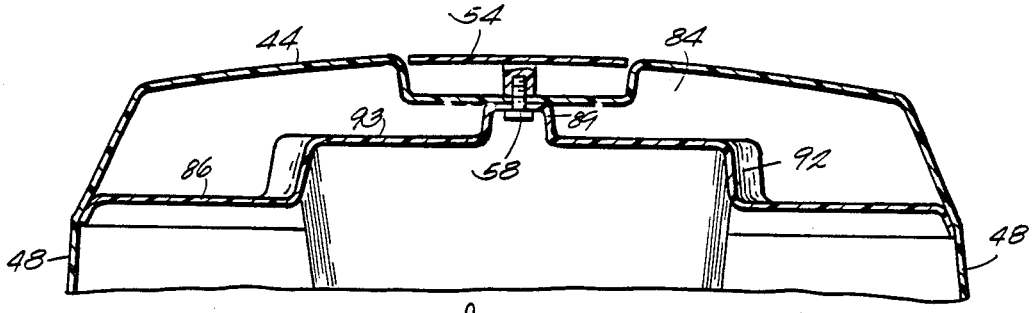
FIG. 5 is a cross-sectional view taken along line 5—5 in FIG. 3.

In the preferred embodiment, the baffle 86 includes (see FIG. 3) an upwardly extending recessed portion 88 which provides room for the flywheel 27. The baffle 86 can be connected to the cowl assembly 34 by any suitable means. In the illustrated construction, the baffle 86 is connected to the cowl assembly 34 by the same screws 58 which connect the tilt handle 54 to the cowl assembly 34. In the preferred embodiment, as shown in FIGS. 3 and 5, the baffle 86 includes an upwardly extending projection 89 which is secured to the top wall 44 by one of the screws 58.

Figure 2:
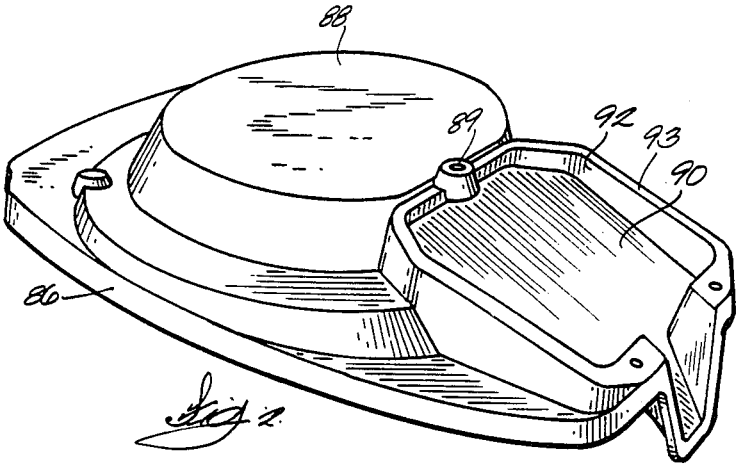
FIG. 2 is a perspective view of the baffle.

While various suitable water preventing means can be employed, in the preferred embodiment, such means includes, on the baffle 86, a wall portion 90 (FIGS. 2 and 3) extending upwardly adjacent the air inlet 52 and toward the front of the cowl assembly 34. In the illustrated construction, as shown in FIG. 3, the wall portion 90 is located beneath the inlet opening 52. The wall portion 90 includes a lower end located above the lower portion 36 of the cowl assembly 34 so that water entering the air inlet 52 runs down the wall portion 90 into the lower portion 36 of the cowl assembly 34. In the illustrated construction, as best shown in FIG. 2, the baffle 86 includes an upwardly extending wall 92 surrounding the wall portion 90 (except for the lower end of the wall portion 90) to aid in directing water toward the lower end of the wall portion 90. The wall 92 has an upper edge 93. The water can be removed from the lower portion 36 of the cowl assembly 34 by any suitable means (not shown), such as the aspirator device disclosed in U.S. Pat. No. 4,403,972, issued Sept. 13, 1983.

The air intake system operates as follows. Air enters the cowl assembly 34 through the opening 56 and the air inlet 52. Most of the water which enters the air inlet 52 will impinge upon the wall portion 90 and will drain into the lower portion 36 of the cowl assembly 34. This water will be removed by the above-mentioned aspirator device. From the air inlet 52, air passes laterally or forwardly over the upper edge 93 of the wall 92 of the baffle 86 and then forwardly around the projection 89 (see FIG. 5) through the passage 84 defined by the baffle 86 and the top wall 44. From the passage 84, the air enters the chamber 60. Any water which is carried by the air to the chamber 60 will travel to the bottom of the chamber 60 and will drain out of the chamber 60 through the opening 82 between the bottom wall 40 and the lower end of the cover plate 68. Air in the chamber 60 passes through the openings 72 in the cover plate 68 and enters the air silencing chamber 70. From the air silencing chamber 70, the air passes through the openings 66 in the base plate 64 and enters the air intakes 30.

Figure 8:
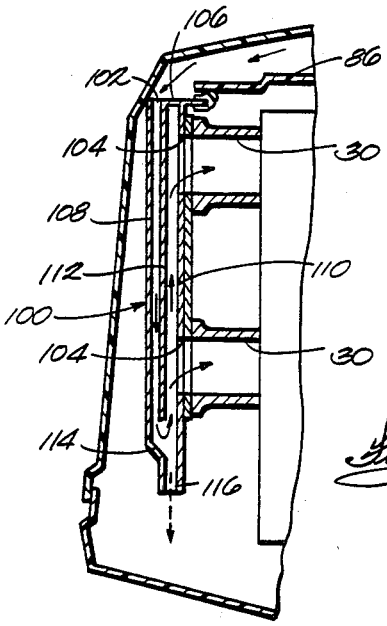
FIG. 8 is a partial side elevational view, partially in cross section, of a marine propulsion device which is an alternative embodiment of the invention.

An alternative embodiment of the invention is illustrated in FIG. 8. In the alternative embodiment, the marine propulsion device 10 comprises an air silencer 100 including a silencer inlet 102, silencer outlets 104 communicating with the air intakes 30, and means defining a tortuous passage communicating between the silencer inlet 102 and the silencer outlets 104 for conducting air from the silencer inlet 102 to the silencer outlets 104 and for substantially preventing water entering the silencer inlet 102 from reaching the air intakes 30. Thus, the tortuous passage means provides additional means for preventing water from entering the air intakes 30.

In the illustrated construction, the air silencer 100 includes a top wall 106 and spaced apart front and rear walls 108 and 110, respectively. The silencer inlet 102 is located in the top wall 106 adjacent the front wall 108, and the silencer outlets 104 are located in the rear wall 110. While various suitable tortuous passage means can be used, in the illustrated construction, the tortuous passage means includes a baffle wall 112 extending downwardly from the top wall 106 intermediate the silencer inlet 102 and the rear wall 110. The baffle wall 112 is spaced from both the front wall 108 and the rear wall 110 and extends downwardly to a point beneath the silencer outlets 104. Air entering the silencer inlet 102 must pass downwardly between the baffle wall 112 and the front wall 106, rearwardly beneath the baffle wall 112, and upwardly between the baffle wall 112 and the rear wall 110 to the silencer outlets 104.

Preferably, the air silencer 100 further includes a bottom wall 114 defining a low point of the tortuous passage, and a drain opening 116 located in the bottom wall 114 and communicating with the tortuous passage at the low point. Thus, any water that enters the silencer inlet 102 should exit the air silencer 100 through the drain opening 116.

Various features and advantages of the invention are set forth in the following claims.

I claim:

1. A marine propulsion device comprising a propulsion unit including a rotatably mounted propeller, and an engine drivingly connected to said propeller and including a flywheel and an air intake, a cowl assembly surrounding said engine and including an air inlet and an upper interior surface, and wall means for conducting incoming air from said air inlet to said engine air intake and, at the same time, for isolating the incoming air from said engine, said wall means engaging such interior surface and including a portion spaced from said interior surface and cooperating with said interior surface to define a passage spaced from said engine and communicating between said air inlet and said engine air intake.

2. A marine propulsion device as set forth in claim 1 wherein said cowl assembly includes an upper portion, and wherein said air inlet is located in said upper portion.

3. A marine propulsion device as set forth in claim 1 wherein said cowl assembly has a front and a rear, wherein said air intake is located adjacent said front of said cowl assembly, and wherein said air inlet is located in said rear of said cowl assembly.

4. A marine propulsion device as set forth in claim 1 wherein said cowl assembly has a front and an upper rear, wherein said air intake is located adjacent said front of said cowl assembly, and wherein said air inlet is located in said upper rear of said cowl assembly.

5. A marine propulsion device as set forth in claim 2 wherein said cowl assembly has a front and a rear, wherein said air intake is located adjacent said front of said cowl assembly, wherein said air inlet is located in said rear of said cowl assembly.

6. A marine propulsion device as set forth in claim 5 wherein said conducting and isolating means includes means defining a chamber located adjacent said front of said cowl assembly, said chamber communicating with said engine air intake and being otherwise substantially sealed from said engine, and wherein said conducting and isolating means conducts air from said air inlet to said chamber.

7. A marine propulsion device as set forth in claim 6 wherein said conducting and isolating means conducts air above said engine from said air inlet to said chamber.

8. A marine propulsion device as set forth in claim 7 wherein said cowl assembly includes a top wall and an interior surface, and wherein said conducting and isolating means includes wall means sealingly connected to said interior surface and spaced from said top wall to define a passage communicating between said air inlet and said chamber.

9. A marine propulsion device as set forth in claim 8 wherein said isolating and conducting means includes means for substantially preventing water entering said air inlet from reaching said air intake.

10. A marine propulsion device as set for in claim 9 wherein said cowl assembly includes a pan-like lower portion, wherein said wall means includes a wall portion extending upwardly adjacent said air inlet and toward said front of said cowl assembly, said wall portion including a lower end located above said lower portion of said cowl assembly so that water entering said air inlet runs down said wall portion into said lower portion of said cowl assembly, and wherein said water preventing means includes said wall portion.

11. A marine propulsion device as set forth in claim 6 wherein said cowl assembly has an interior surface, and wherein said means defining said chamber includes an air silencer plate generally sealingly connected to said interior surface of said cowl assembly and spaced from said cowl assembly to define said chamber, said plate having therein an opening communicating with said air intake.

12. A marine propulsion device as set forth in claim 1 wherein said cowl assembly has opposite top and bottom walls, opposite front and rear walls, and opposite side walls, wherein said air intake is located adjacent said front wall, wherein said air inlet is located adjacent said rear wall, and wherein said conducting and isolating means includes an air silencer plate extending between said side walls and being spaced from said front wall to define a first chamber between said front wall and said plate, said plate at least partially defining an air silencing chamber communicating with said air intake, said plate including an opening communicating between said first chamber and said air silencing chamber, and said plate having an upper end spaced from said top wall to define an opening communicating with said first chamber, and said conducting means also including a baffle extending between said side walls and rearwardly from said upper end of said plate, said baffle having a rearward end located adjacent said air inlet, and said baffle being spaced from said top wall to define a passage between said baffle and said top wall, said passage communicating between said air inlet and said opening into said first chamber.

13. A marine propulsion device as set forth in claim 12 wherein said plate has a lower end spaced from said bottom wall to define an opening which communicates with said first chamber and through which water can drain from said first chamber.

14. A marine propulsion device comprising a propulsion unit including a rotatably mounted propeller, and an engine drivingly connected to said propeller and including a flywheel and an air intake, a cowl assembly surrounding said engine and including a front located adjacent said air intake and a rear including an air inlet, and means for isolating incoming air from said engine and for conducting the incoming air around said engine from said air inlet to said engine air intake, said isolating and conducting means including means for defining a chamber formed in part by said front of said cowl assembly, said chamber communicating with said engine air intake, being otherwise substantially sealed from said engine, and communicating with said air inlet.

15. A marine propulsion device as set forth in claim 14 wherein said isolating and conducting means conducts air above said engine from said air inlet to said chamber.

16. A marine propulsion device as set forth in claim 15 wherein said cowl assembly includes a top wall and an interior surface, and wherein said isolating and conducting means includes wall means sealingly connected to said interior surface and being spaced from said top wall to define a passage extending between said cowl interior surface and said wall means and above said engine and communicating between said air inlet and said chamber.

17. A marine propulsion device as set forth in claim 16 wherein said isolating and conducting means includes baffle means for substantially preventing water entering said air inlet from reaching said air intake.

18. A marine propulsion device as set forth in claim 17 wherein said cowl assembly includes a pan-like lower portion, wherein said baffle means includes a wall portion extending upwardly adjacent said air inlet and towards said front portion of said cowl assembly, said wall portion including a lower end located above said lower portion of said cowl assembly so that water entering said air inlet runs down said wall portion into said lower portion of said cowl assembly, and wherein said water preventing means includes said wall portion.

19. A marine propulsion device as set forth in claim 14 wherein said cowl assembly has an interior surface, and wherein said means defining said chamber includes a plate sealingly connected to said interior surface of said cowl assembly and otherwise spaced from said cowl assembly to define said chamber, said plate having therein an opening communicating with said engine air intake.

20. A marine propulsion device as set forth in claim 14 wherein said cowl assembly has opposite top and bottom walls, opposite front and rear walls, and opposite side walls, and wherein said isolating and conducting means includes a plate extending between said side walls and being spaced from said front wall to define a first chamber between said front wall and said plate, said plate at least partially defining an air silencing chamber communicating with said engine air intake, said plate including an opening communicating between said first chamber and said air silencing chamber, and said plate having an upper end spaced from said top wall to define an open area communicating with said first chamber, and said isolating and conducting means also including a baffle extending between said side walls and rearwardly from said upper end of said plate, said baffle having a rearward end located adjacent said air inlet, and said baffle being spaced from said top wall to define a passage between said baffle and said top wall, said passage communicating between said air inlet and said open area communicating with said first chamber.

21. A marine propulsion device as set forth in claim 20 wherein said plate has a lower end spaced from said bottom wall to define an opening which communicates with said first chamber and through which water can drain from said first chamber.

22. A marine propulsion device comprising a propulsion unit including a rotatably mounted propeller, and an engine drivingly connected to said propeller and including an air intake, a cowl assembly surrounding said engine and including an air inlet, an air silencer including spaced apart front and rear walls, a top wall, a silencer inlet located in said top wall adjacent said front wall, a silencer outlet located in said rear wall and commuicating with said engine air intake, and means defining a tortuous passage communicating between said silencer inlet and said silencer outlet for conducting incoming air from said silencer inlet to said silencer outlet and for draining, from said air silencer, water in the incoming air traveling from said silencer inlet to said engine intake so as to substantially prevent water entering said silencer inlet from reaching said engine air intake, said means including a baffle wall extending downwardly from said top wall intermediate said silencer inlet and said rear wall, said baffle wall extending to a point beneath said silencer outlet, whereby air entering said silencer inlet must pass downwardly between said baffle wall and said front wall, beneath said baffle wall, and upwardly between said baffle wall and said rear wall to said silencer outlet, and means for conducting air from said air inlet to said silencer inlet.

23. A marine propulsion device as set forth in claim 22 wherein said tortuous passage includes a low point, and wherein said air silencer further includes a drain opening communicating with said tortuous passage at said low point.

24. A marine propulsion device as set forth in claim 23 wherein said air silencer further includes a bottom wall having therein said drain opening.

* * * * *